US005127467A

United States Patent [19]

Ueno

[11] Patent Number: 5,127,467

[45] Date of Patent: Jul. 7, 1992

[54] METHOD AND APPARATUS FOR AUTOMATICALLY SUPPLYING MOLTEN METAL FOR DIE CASTING MACHINE

[75] Inventor: Toyoaki Ueno, Yamaguchi, Japan

[73] Assignee: Ube Industries, Ltd., Yamaguchi, Japan

[21] Appl. No.: 542,429

[22] Filed: Jun. 22, 1990

[30] Foreign Application Priority Data

| | | | |
|---|---|---|---|
| Jun. 23, 1989 | [JP] | Japan | 1-159747 |
| Jun. 30, 1989 | [JP] | Japan | 1-166606 |
| Jul. 11, 1989 | [JP] | Japan | 1-177212 |
| Aug. 22, 1989 | [JP] | Japan | 1-214115 |

[51] Int. Cl.[5] ..... B22D 17/12; B22D 17/30; B22D 17/32

[52] U.S. Cl. ..... 164/457; 164/113; 164/136; 164/154; 164/155; 164/312; 164/314

[58] Field of Search ..... 164/113, 312, 314, 457, 164/154, 155, 136

[56] References Cited

U.S. PATENT DOCUMENTS

| | | | |
|---|---|---|---|
| 4,088,178 | 5/1978 | Ueno et al. | 164/314 |
| 4,286,648 | 9/1981 | Takeshima et al. | 164/312 |
| 4,287,935 | 9/1981 | Ueno et al. | 164/314 |
| 4,505,307 | 3/1985 | Uchida | 164/136 X |
| 4,655,274 | 4/1987 | Dannoura | 164/341 |
| 4,690,197 | 9/1987 | Dannoura | 164/312 |
| 4,741,379 | 5/1988 | Dannoura | 164/312 |
| 4,842,038 | 6/1989 | Fujino et al. | 164/113 X |
| 4,860,818 | 8/1989 | Dannoura | 164/113 X |
| 4,871,010 | 10/1989 | Dannoura | 164/312 X |
| 4,997,027 | 3/1991 | Akimoto | 164/312 |
| 5,014,767 | 5/1991 | Ueno | 164/312 |

FOREIGN PATENT DOCUMENTS

| | | |
|---|---|---|
| 57-169592 | 10/1982 | Japan . |
| 58-107263 | 6/1983 | Japan . |
| 59-153563 | 9/1984 | Japan . |

*Primary Examiner*—J. Reed Batten, Jr.

*Attorney, Agent, or Firm*—Blakely, Sokoloff, Taylor & Zafman

[57] ABSTRACT

In a method and apparatus for supplying a molten metal, a supplying operation of the molten metal is started after a molten metal discharge port formed in a lower end portion of a molten metal supply sleeve facing down on a bottom portion of a molten metal supply vessel is positioned right above a plunger chip located at a lower position within an injection sleeve of an injection apparatus. The injection sleeve and the plunger chip are simultaneously lowered in accordance with the supplying operation of the molten metal.

17 Claims, 11 Drawing Sheets

METHOD AND APPARATUS FOR AUTOMATICALLY SUPPLYING MOLTEN METAL FOR DIE CASTING MACHINE

BACKGROUND OF THE INVENTION

The present invention relates to a method and apparatus for teeming molten metal into a vertical sleeve in a vertical die casting machine.

Die casting machines are classified into a vertical clamping type machine and a horizontal clamping type machine according to a clamping direction. They are also classified into a vertical casting type machine and a horizontal casting type machine according to a casting direction. Of these types of machines, the horizontal clamping/vertical die casting machine is generally constituted as follows.

A pair of stationary platens are arranged upright on a machine base so as to oppose each other and are connected by tie rods at their four corners. A movable platen is supported on the tie rods so as to be movable forward/backward in a direction to move close to or away from one stationary platen. Movable and stationary metal molds are respectively mounted on the movable platen and one stationary platen. A cavity is formed in a joining portion of the stationary metal mold and the movable metal mold which is moved together with the movable platen by a clamping cylinder on the side of the other stationary platen so as to perform clamping. A stationary sleeve communicating with the cavity is fitted in the stationary metal mold so as to open below. An injection apparatus is supported below the stationary metal mold so as to be set upright/tilted or laterally moved. The injection apparatus comprises an injection cylinder secured to an injection frame, and a plunger coupled to a piston rod of the cylinder and having a plunger chip fitted in a vertically movable injection sleeve arranged on the injection frame.

When a molten metal is to be supplied to the injection apparatus having such an arrangement, the entire injection apparatus is titled, and a molten metal supplying operation is performed by a molten metal supply apparatus. In this case, the supplying operation is started while the plunger chip is set at the highest position. As the operation proceeds, a predetermined amount of molten metal is teemed while only the plunger chip is lowered without changing the position of the injection sleeve, or is teemed while the plunger chip is set at the lowest position.

When the supplying operation is completed in this manner, the injection apparatus is set upright to bring the injection sleeve into contact with the stationary sleeve. The plunger chip of the injection cylinder is moved upward to inject the molten metal into the cavity via the stationary sleeve. Thereafter, the molten metal is solidified and a cast product is obtained.

If, however, only the plunger chip is lowered to supply a molten metal into the injection sleeve, in addition to a molten metal contact surface coated with a mold release agent, a non-coated portion is exposed to cause seizing. Alternatively, if a molten metal is supplied from a high position, inclusion of a gas or oxides may occur.

SUMMARY OF THE INVENTION

It is, therefore, a principal object of the present invention to provide a method and apparatus for supplying a molten metal for a die casting machine, which can prevent seizing caused when a molten metal is teemed into an injection sleeve and adheres to a portion on which no mold release agent is coated.

It is another object of the present invention to provide a method and apparatus for supplying a molten metal, which can more effectively suppress inclusion of a gas or oxides during a molten metal supplying operation to an injection sleeve than a conventional apparatus.

In order to achieve the above objects, according to the present invention, there is provided a method of supplying a molten metal, comprising the steps of starting a supplying operation of the molten metal after a molten metal discharge port formed in a lower end portion of a molten metal supply sleeve facing down on a bottom portion of a molten metal supply vessel is positioned right above a plunger chip located at a lower position within a injection sleeve of an injection apparatus, and simultaneously lowering the injection sleeve and said plunger chip in accordance with the supplying operation of the molten metal.

According to another aspect of the present invention, there is provided a molten metal supply structure comprising a molten metal supply vessel having a molten metal supply sleeve facing down on a bottom portion thereof, and a mechanism for positioning a molten metal discharge port in a lower end portion of the molten metal supply sleeve right above a plunger chip located at a lower position within an injection sleeve of an injection apparatus, in which the plunger chip is housed to be axially movable, and for simultaneously lowering the injection sleeve and the plunger chip in relation to a molten metal supplying operation.

BRIEF DESCRIPTION OF THE DRAWINGS

FIGS. 3 and 4 show an embodiment of an injection apparatus to which the present invention is applied, in which FIG. 3 is a plan view showing the injection apparatus, and FIG. 4 is a longitudinal sectional view showing the injection apparatus taken along the line IV—IV of FIG. 3;

DETAILED DESCRIPTION OF THE PREFERRED EMBODIMENTS

Figure 1:
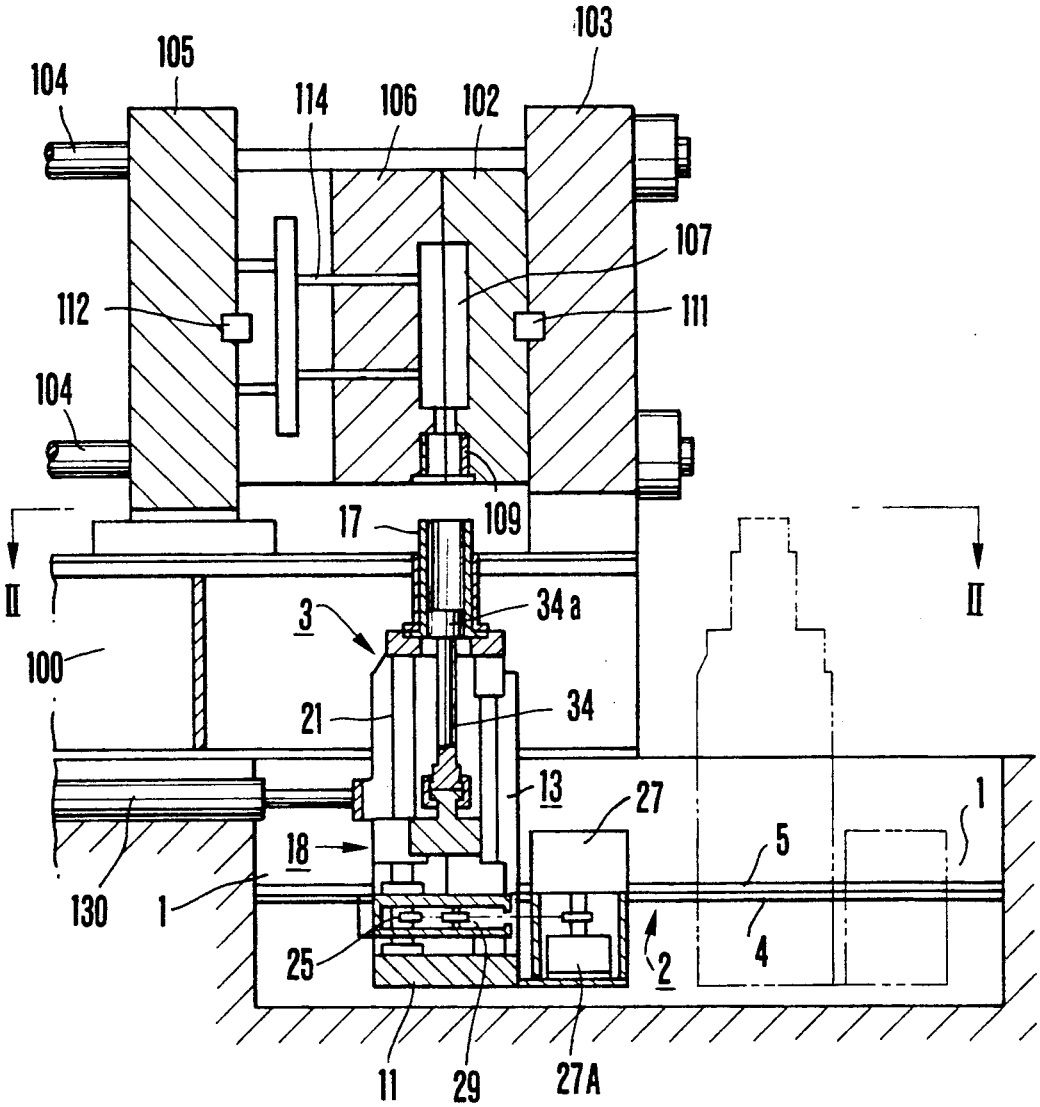
FIG. 1 is a sectional view showing basic arrangements of a vertical die casting machine and an injection apparatus to which the present invention is applied.
Figure 2:
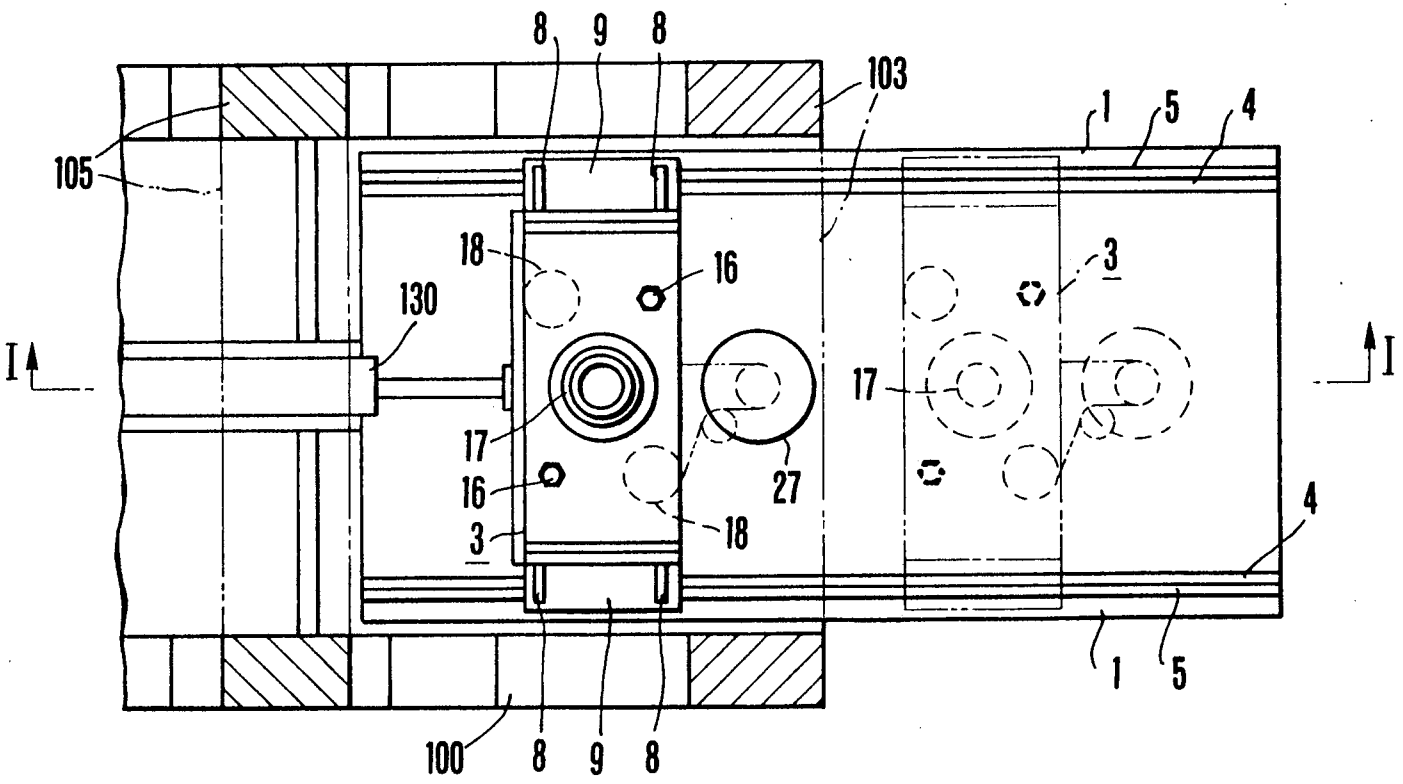
FIG. 2 is a sectional view taken along the line II—II of FIG. 1.
Figure 3:
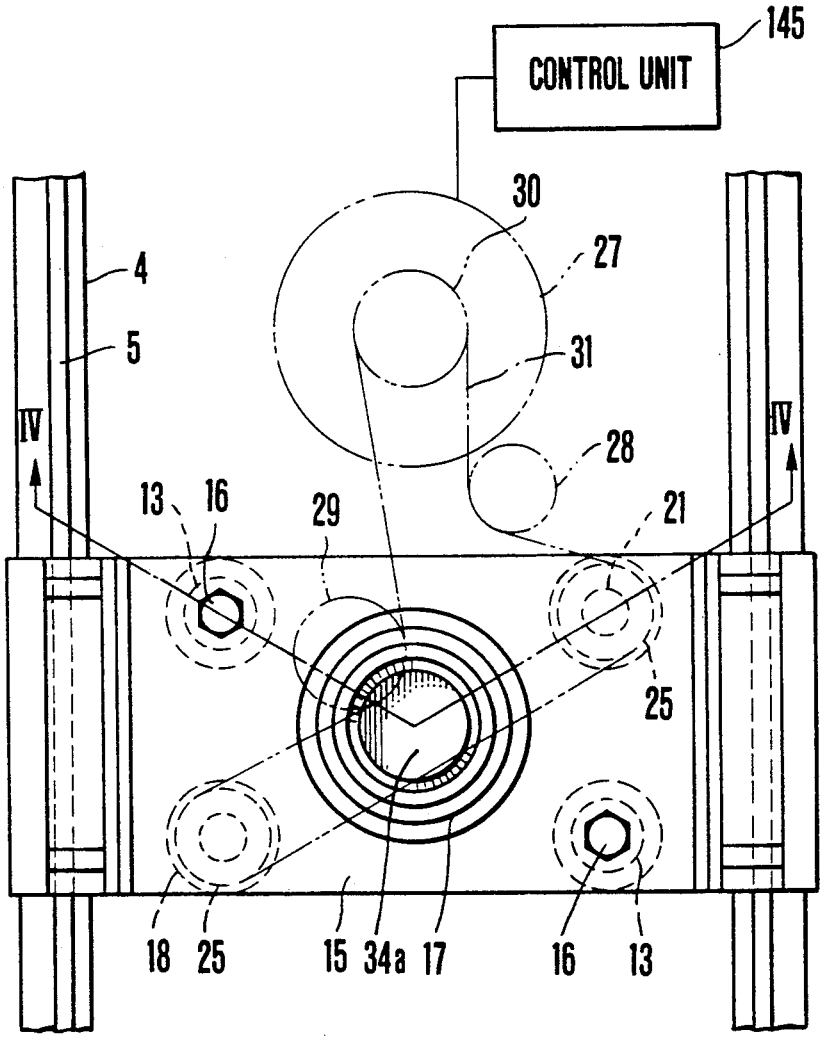

FIGS. 1 to 4 show basic arrangements of a vertical die casting machine according to an embodiment of the present invention and an injection apparatus for the machine. Referring to FIGS. 1 to 4, this die casting machine comprises, on its machine base 100, a vertically secured stationary platen 103 mounting a stationary metal mold 102, a movable platen 105 which moves along a plurality of columns or tie bars 104 extending horizontally from the stationary platen 103, and a movable metal mold 106 which moves from the movable platen 105 toward the stationary platen 102 to form a cavity 107. Reference numeral 109 denotes a split sleeve; 111 and 112, keys for preventing the vertical movement of the metal molds 102 and 106, respectively; and 114, a push-out sleeve for removing a cast product from the movable metal mold 106. These parts are basic elements constituting the die casting machine.

A pair of linear guides 2 (see FIG. 2) are secured to a frame 1 provided below the die casting machine. An injection apparatus generally denoted by reference numeral 3 is guided by the linear guides 2 to horizontally move between an injection position located below the metal molds and a metal mold injection position indicated by alternate long and two short dashed lines, as shown in FIG. 1. That is, each linear guide 2 includes an elongated rail 5 (see FIG. 4) supported by a supporting plate 4 at the frame 1 side and having a substantially square section. As clearly shown in FIG. 4, a plurality of balls 6 are held in ball grooves formed in both the side surfaces of the rail 5 and roll therein. A plurality of ball holders 9 each having an inverted U-shaped section and side surfaces protected by covers (not shown) are fixed to a cylindrical member 7 of the injection cylinder 3 via a reinforcing member 8. A ball groove for holding the balls 6 is formed in the inner surface of each ball holder 9. With this arrangement, when the injection apparatus 3 is driven by a driving unit 130 including a cylinder secured to the frame 11, the apparatus 3 smoothly moves while the balls 6 roll in the ball grooves.

The injection apparatus 3 supported as described above includes an annular upper frame 10 secured to the upper end of the cylindrical member 7 and a disc-like lower frame 11 secured to the lower end thereof. A ram portion 13*a* of an elevating shaft 13 extending upward is fitted to be movable upward/downward in a ram hole 12*a* of an elevating cylinder 12 provided at a position where an outer circumferential portion of the lower frame 11 is divided into two parts in the circumferential direction. An oil supply source 135 is connected to the ram hole 12*a* of the elevating cylinder 12 via a flexible pipe. The elevating shaft 13 is axially supported to be movable upward/downward by the upper frame 10 via a linear ball bearing 14, and a sleeve frame 15 having a substantially rectangular shape is secured to the upper end portion of the elevating shaft 13 by a plurality of bolts 16. A cylindrical injection sleeve 17 is fixed to a central portion of the sleeve frame 15 so as to be concentrical with a metal mold stationary sleeve 109 provided above the injection sleeve 17. When an oil is supplied from the oil supply source 135 to a lower portion of the ram hole 12*a* of the elevating cylinder 12, the injection sleeve 17 is moved upward together with the injection sleeve 17 and connected to the stationary sleeve 109.

Reference numeral 18 denotes a supporting frame having a boss portion 18*a* formed at a position where its outer circumferential portion is divided into two parts in the circumferential direction and supported by the elevating shaft 13 via a linear ball bearing 19. The descent limit of the supporting frame 18 is regulated by a nut 20 threadably engaged with a threaded portion of the elevating shaft 13. The supporting frame 18 is supported to be movable upward/downward by a pair of parallel screw shafts 21 having a substantially 60° phase difference in the circumferential direction with respect to the elevating shaft 13. That is, a saucer-like intermediate frame 22 is located in a space between the supporting frame 18 and the lower frame 11 and open downward, and a pair of bearing holes are formed at positions corresponding to the screw shafts 21. A small-diameter portion of the screw shaft 21 is axially supported by the bearing hole via a bearing 23 and a thrust bearing 24. A movement of the screw shaft 21 in the axial direction with respect to the intermediate frame 22 is regulated by its step portion, a sprocket 25 fixed to the small-diameter portion by a key, and a nut 26 threadably engaged with the threaded portion. A motor 27 with a brake 27A and a pair of idlers 28 and 29 are mounted on the intermediate frame 22. A chain 31 is looped between a sprocket 30 of the motor 27, the idlers 28 and 29, and the sprocket 25 on the screw shaft 21. Therefore, the screw shaft 21 is rotationally driven by the motor 27 via the chain 31. A plurality balls 32 are aligned and held in a spiral groove in the screw shaft 21. A ball holder 33 fitted in and fixed to a holder hole 18*b* of the supporting frame 18 by a bolt is fitted on the screw shaft 21, and balls 32 are held in a spiral ball groove formed in its inner hole. With this arrangement, when the screw shaft 21 rotates, the supporting frame 18 moves upward/-downward while the balls 32 roll in the ball groove. A plunger 34 coupled by a coupling 35 extends upward from the central portion of the supporting frame 18. A plunger tip 34*a* as a head portion of the plunger 34 is inserted to be movable forward/backward in the inner hole. With this arrangement, a molten metal teemed in the inner hole of the injection sleeve 17 is pushed by the plunger tip 34*a* upon upward movement of the plunger 34 and injected into a die cavity via the stationary sleeve. Reference numeral 36 is a cover having a semi-circular section and supported by a cover 37 fixed to the supporting frame 18 to cover the screw shaft 21 together with the cover 37. The cover 36 is arranged to project integrally with the supporting frame 18 along and above the upper frame 15. A water cooling conduit 38 extends through the central portion of the plunger 34 and opens to the outer circumferential portion of the supporting frame 18. A hose mounted on the opening portion is connected to a cooling pump (not shown). A lower opening end of the intermediate frame 22 is closed by an oil receiving plate 39. A saucer-like oil pan 40 is formed in the inner surface of the oil receiving plate 39 to surround the screw shaft 21.

A member generally denoted by reference numeral 41 is a molten metal urging cylinder disposed below each screw shaft 21. The molten metal urging cylinder 41 includes a cylinder hole 11*a* having upper and lower portions closed by cover member 42 and 43 and formed in the lower frame 11, and a piston 44 fitted to be movable forward/backward in the cylinder hole 11*a*. A lower cylinder chamber at the lower portion of the piston 44 is connected to a hydraulic device via an oil passage 45 and a conduit. A gap of about 1 mm denoted by reference symbol t is formed between the lower end descent limit of the screw shaft 21 and the upper end descent limit of the piston 44. With this arrangement, after the plunger tip 34 *a* moves upward and a molten metal is filled in a cavity, an oil is supplied to the lower portion of the piston 44 to move the piston 44 upward. The piston 44 is brought into contact with the screw shaft 21 and further moved upward by about 5 mm. As a result, the plunger 34 is moved upward via the supporting frame 18 to perform a molten metal urging operation.

An operation of the injection apparatus having the above arrangement will be described below. When the entire injection apparatus 3 is pushed to the right in FIG. 2 (to the depth of FIG. 4) by the driving device 130, the injection apparatus 3 moves to the metal mold teeming position indicated by the alternate long and two short dashed lines in FIG. 1 while the balls 6 of the linear guide 2 roll in the ball groove, thereby teeming the molten metal into the injection sleeve 17. This operation will be described in detail with reference to FIG. 6. After the teeming, the injection apparatus 3 is returned to the lower position (indicated by the solid line in FIG. 2) of the injection position.

When an oil is supplied from the oil supply source 135 to the ram hole 12*a* of the elevating cylinder 12, the elevating shaft 13 moves upward while the balls of the linear ball bearings 14 and 19 roll, and the injection sleeve 17 formed integrally with the elevating cylinder 12 is moved upward and connected to the metal mold stationary sleeve 109. In this case, the supporting frame 18 is urged against the nut 20 and moved upward by a ball screw device constituted by the screw shaft 21, the balls 32, and the ball holders 33, and the plunger tip 34*a* moves upward in synchronism with the injection sleeve 17, i.e., while maintaining the same positional relationship with respect to the injection sleeve 17. Therefore, the molten metal does not overflow from the injection sleeve 17.

After the injection sleeve 17 moves upward to its ascent limit and stops, the plunger 34 starts upward movement. First, when the motor 29 is started under the control of a control unit 145 to rotate the two screw shafts 21 in synchronism with each other via the chain 31, the supporting frame 18 moves upward by the screw shafts 21 while the balls 32 roll in the grooves and the linear ball bearings 19 move along the elevating shaft 13. The plunger 34 and the plunger tip 34*a* with the supporting frame 18 move upward relatively to the sleeve frame 15. As a result, the plunger tip 34*a* moves upward in the injection sleeve 17, and the molten metal is injected in the die cavity 107 via the stationary sleeve 109 shown in FIG. 1.

Figure 4:
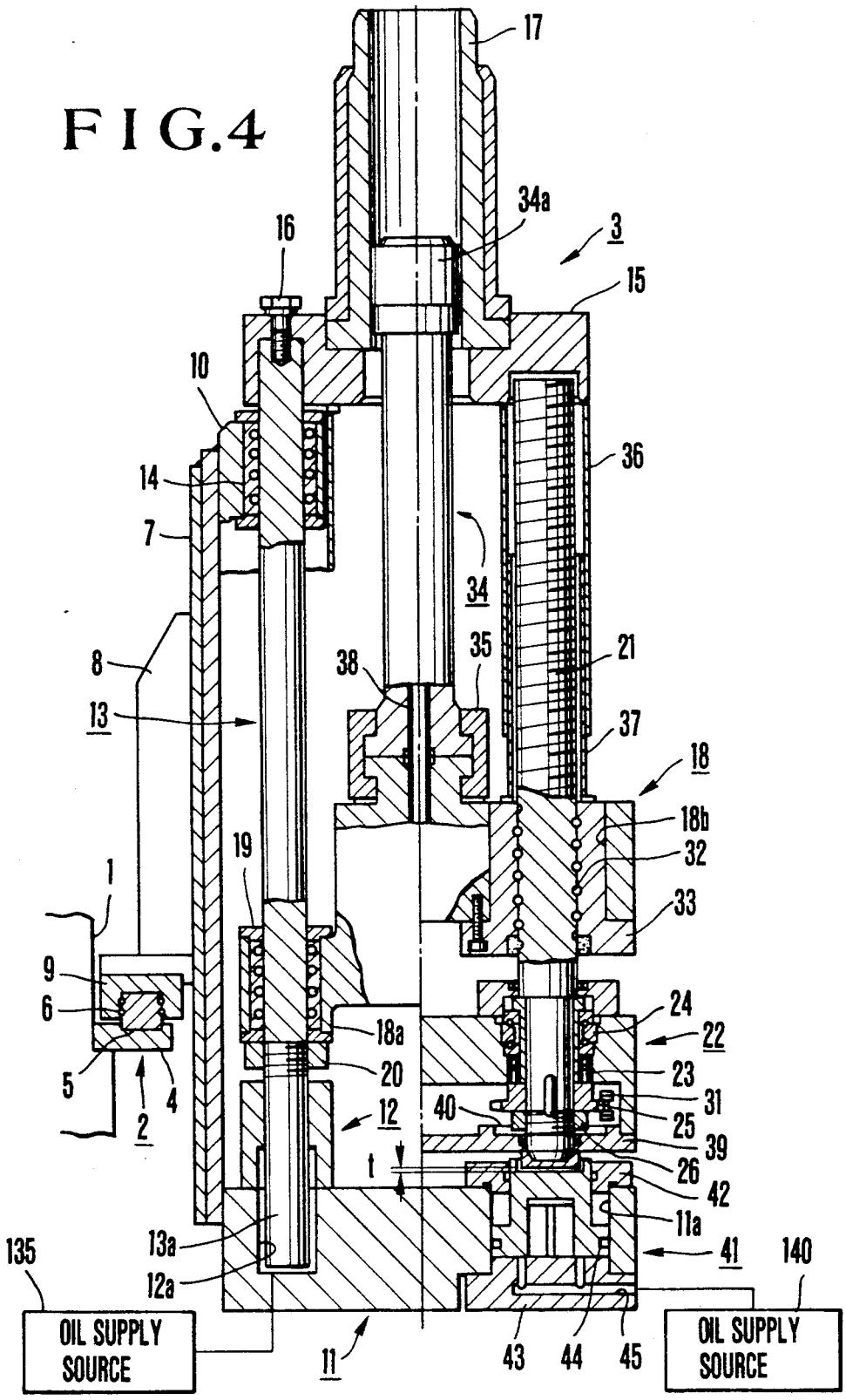

After the molten metal is filled in the die cavity 107, the motor 27 is stopped under the control of the control unit 145. During injection, the intermediate frame 22 is not moved upward but kept stopped. When the molten metal is completely filled in the cavity, an oil is supplied to the lower portion of the piston 44 of the molten metal urging cylinder 41 to move the piston 44 upward. The piston 44 is brought into contact with the screw shafts 21 to move the screw shafts 21 upward together with the intermediate frame 22 by about 5 mm. Therefore, the supporting frame 18 move upward with the plunger tip 34*a*, and the molten metal in the cavity 107 is compressed to perform the molten metal urging operation. During such an injection operation, the plunger 34 is cooled since cooling water is supplied to and circulated in a water cooling conduit (FIG. 4).

When the injection operation is finished, die opening is performed after an injection product is cooled and solidified, and the piston 44 of the molten metal urging cylinder 41 is moved backward. The brake 27A formed integrally with the motor 27 is released, and the motor 27 is driven to move the supporting frame 18 backward via the ball screw device, thereby moving the plunger tip 34*a* backward. When the plunger tip 34*a* and the supporting frame 18 are moved backward to predetermined positions, the supporting frame 18 contacts with the nut 20 for pushing it, and the elevating shaft 13, the supporting frame 18, and the injection sleeve 17 are simultaneously moved backward. Thereafter, the injection apparatus 3 is moved to the metal mold teeming position indicated by the alternate long and two short dashed lines in FIG. 2, thereby finishing one cycle.

Figure 5:
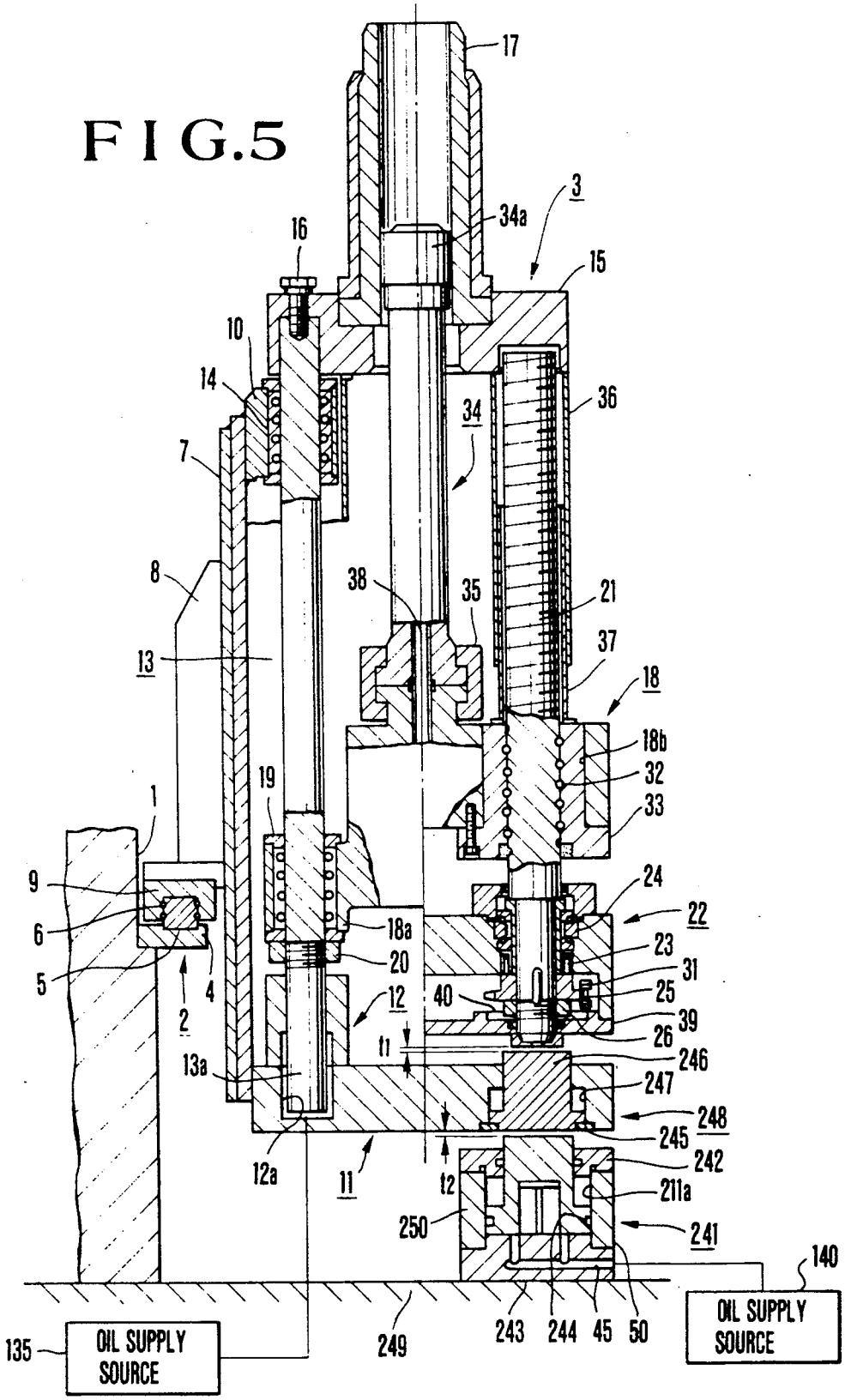
FIG. 5 is a sectional view showing another embodiment of the injection apparatus.

FIG. 5 shows another embodiment of the injection apparatus. This embodiment differs from the above embodiment in that a molten metal urging cylinder is not moved integrally with a plunger 34 but fixed to a stationary base 200. Only a difference between this embodiment and the above embodiment will be described below.

That is, reference numeral 248 denotes an intermediate push-out portion which is a feature of this embodiment. The intermediate push-out portion 248 is disposed below each screw shaft 21 and includes a hole portion 247 closed by a cover member 245 and formed in a lower frame 11 and a splined shaft 246 having a lower projecting portion fitted to be movable forward/backward in the hole portion 247 and an upper portion fitted to be movable upward/downward in the lower frame 11.

A member generally denoted by reference numeral 241 is urging means as a drive source for moving the splined shaft 246 of the intermediate push-out portion 248 upward/downward. In this embodiment, a molten metal urging cylinder 241, for example, is used as the urging means and placed on a stationary base 249 so as to start an operation when an injection apparatus 3 is set at an injection position. A cylinder 250 has an upper cylinder hole 211*a* having upper and lower portions closed by cover members 242 and 243 and a lower piston 244 fitted to be movable forward/backward in the cylinder hole 211*a*. A lower cylinder chamber located below the piston 244 is connected to a hydraulic device 140 via an oil passage 245 formed in the cover member 243 and conduits. A gap having a width of about 1 mm and denoted by reference symbol $t_1$ in FIG. 5 is formed between the lower end descent limit of the screw shaft 21 and the upper end descent limit of the splined shaft 246. In addition, a gap having a width of about 3 mm and denoted by reference symbol $t_2$ in FIG. 5 is formed between the lower end descent limit of the splined shaft 246 and the upper end descent limit of the piston 244. With this arrangement, when an oil is supplied from the hydraulic device 140 to the lower portion of the piston 244 to move the piston 244 upward after the plunger tip 34*a* moves upward to fill a molten metal in a cavity 107, the piston 244 is brought into contact with the splined shaft 246 and then further moved upward by about, e.g., 5 mm. Similarly, after the splined shaft 246 is brought into contact with the screw shaft 21, the screw shaft 21 is moved upward by about, e.g, 5 mm to move the plunger 34 upward via a supporting frame 18, thereby performing a molten metal urging operation.

An operation of the injection apparatus having the above arrangement will be described below. When the entire injection apparatus 3 is pushed in the direction of the lower drawing surface by a driving device, the injection apparatus 3 moves to a molten metal teeming position while balls 6 of a linear guide 2 roll in ball grooves. Therefore, the molten metal is teemed in an injection sleeve 17. After the teeming, the injection apparatus 3 is returned to a lower position of an injection position.

When an oil is supplied to a ram hole 12*a* of an elevating cylinder 12, an elevating shaft 13 is moved upward while balls in linear ball bearings 14 and 19 roll, and the injection sleeve formed integrally with the elevating shaft 13 is moved upward and connected to a stationary sleeve of a metal mold. At this time, a supporting frame 18 is pushed by a nut 20 and moved upward by a ball screw device constituted by the screw shaft 21, balls 32, and ball holders 33. As a result, a plunger tip 34*a* moves upward while maintaining the same positional relationship with respect to the injection sleeve 17. Therefore, the molten metal does not overflow from the injection sleeve 17.

A motor 29 is started to rotate the two screw shafts 21 in synchronism with each other via a chain 31. As a result, the supporting frame 18 moves upward by an action of the screw shafts 21 while the balls 32 roll in the grooves and the linear bearings 19 move along the elevating shaft 13, and the plunger 34 and the plunger tip 34*a* formed integrally with the supporting frame 18 move upward. Therefore, the molten metal in the injection sleeve 17 is injected into the die cavity via the stationary sleeve.

After the molten metal is filled in the die cavity 107, the motor 27 is stopped. During injection, the intermediate frame 22 is not moved upward but kept stopped. When the molten metal is completely filled in the cavity, an oil is supplied to the lower portion of the piston 244 of the molten metal urging cylinder 241 to move the piston 244 upward. The piston 244 is brought into contact with the splined shaft 246, and the splined shaft 246 is brought into contact with the screw shaft 21, thereby moving the screw shaft 21 together with the intermediate frame 22 by about, e.g., 5 mm. Therefore, the supporting frame 18 moves upward together with the plunger tip 34*a* to compress the molten metal in the cavity, thereby performing a molten metal urging operation. Since cooling water is supplied to and circulated in a water cooling conduit 38 during the above injection operation, the plunger 34 is cooled.

After the injection operation is finished and an injected product is cooled and solidified, the molds are opened, and the piston 244 of the molten metal urging cylinder 241 is moved backward. The motor 27 in which a brake is released is driven to move the supporting frame 18 backward via the ball screw devices, thereby moving the plunger tip 34*a* backward. When the plunger tip 34*a* and the supporting frame 18 move backward to predetermined positions, the supporting frame 18 pushes the nut 20, and the elevating shaft 13 and the injection sleeve 17 simultaneously move backward. Thereafter, the injection apparatus 3 is moved to the metal mold teeming position, thereby finishing one cycle.

In this embodiment, the molten metal urging cylinder is separated from the injection apparatus main body and activated when the injection apparatus moves to the molten metal teeming position. As a result, the screw shaft is moved upward via the splined shaft to move the plunger upward via the supporting frame, thereby performing the molten metal urging operation. Therefore, a reaction force acting on the supporting member for supporting the injection apparatus and laterally moving upon molten metal urging can be reduced. As a result, the thickness of the supporting member can be reduced to reduce the weight of the apparatus. In addition, since no flexible conduit is used as a pressurized oil conduit to the molten metal urging cylinder, safety is significantly improved.

A method of supplying a molten metal and an apparatus therefor according to the present invention will be described below with reference to FIGS. 6, 7A to 7C, and 8.

Figure 6:
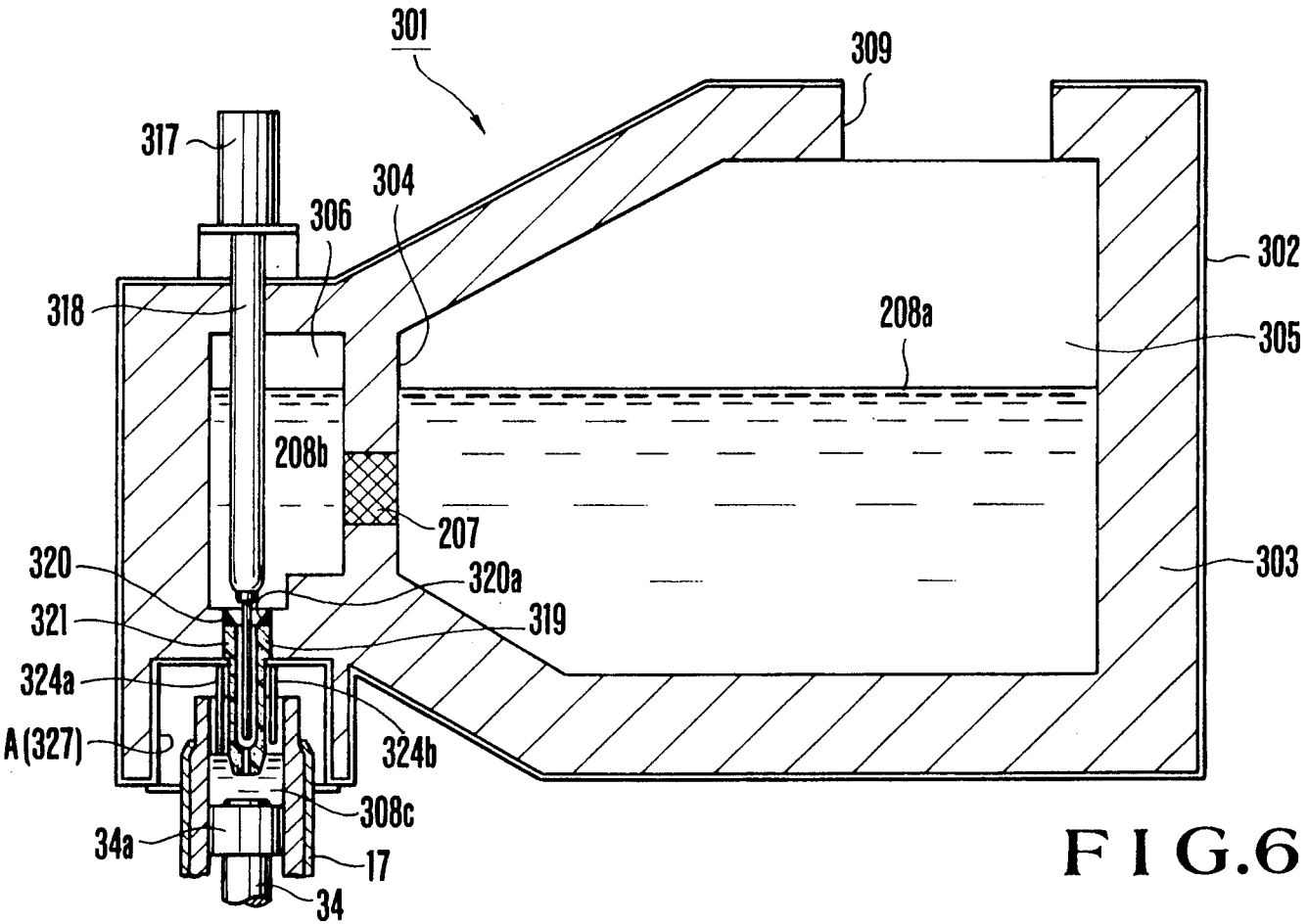
FIG. 6 is a longitudinal sectional view showing an embodiment of an automatic molten metal supply apparatus according to the present invention.
Figure 7A:
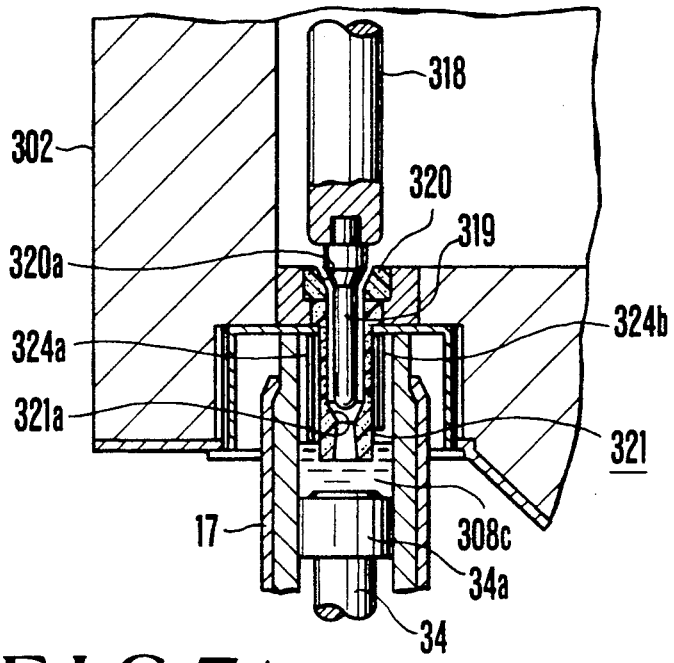
FIGS. 7A to 7C are enlarged view, showing the molten metal supply apparatus, for explaining a method of supplying a molten metal according to the present invention.
Figure 7B:
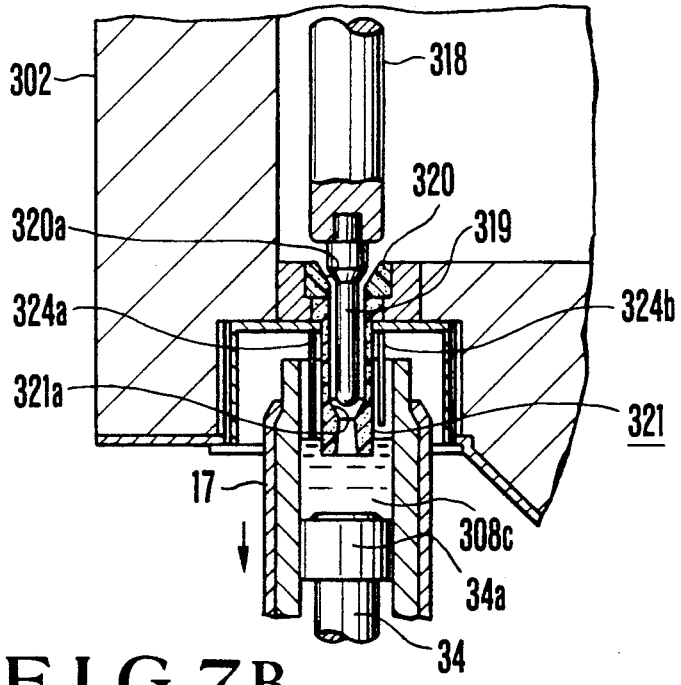
Figure 7C:
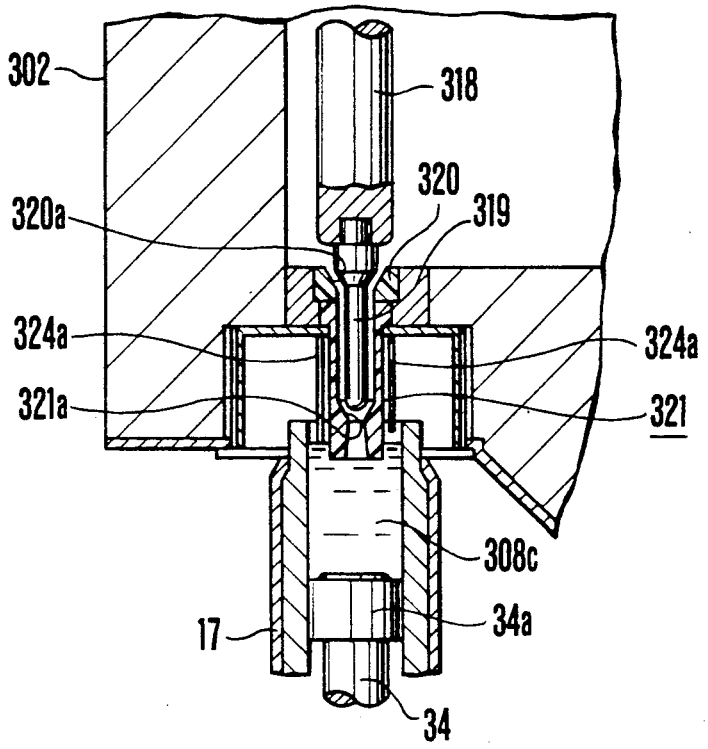
Figure 8:
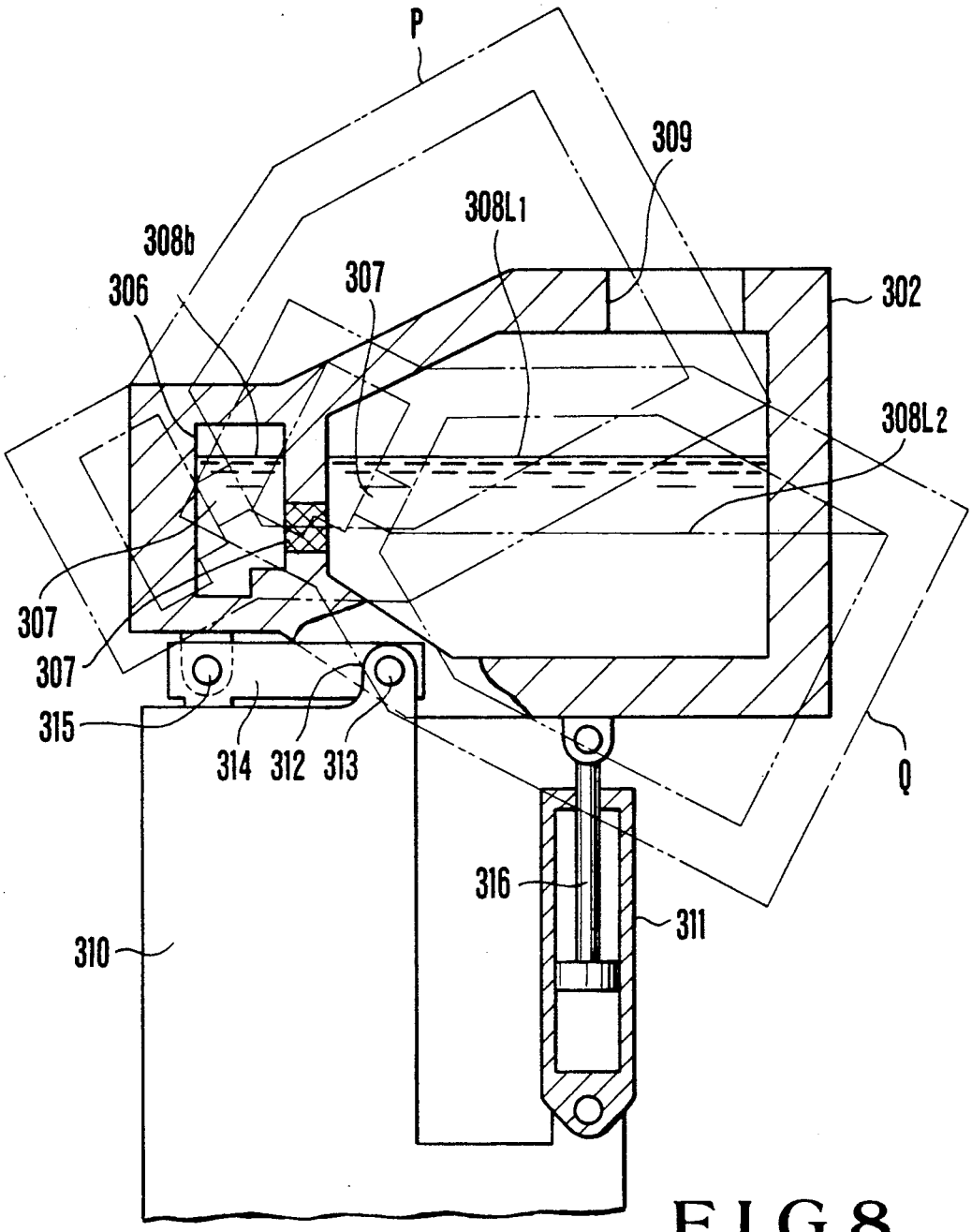
FIG. 8 is a partially cutaway sectional view for explaining an operation of the apparatus in FIG. 5.

FIG. 6 shows an automatic molten metal supply apparatus. FIGS. 7A to 7C show an operation sequence of an injection sleeve and a plunger chip when a molten metal is to be supplied from the automatic molten metal supply apparatus into the injection sleeve. FIG. 7A shows a state immediately after a molten metal supplying operation; FIG. 7B, a state in the process of the supplying operation; and FIG. 7C, a state after the operation. FIG. 8 shows the overall apparatus.

The automatic molten metal supply apparatus of the present invention will be described below. Referring to FIG. 6, a furnace 302 of an automatic molten metal supply apparatus 301 is formed into a substantially rectangular box-like shape as a whole. A heater 303 is embedded in the outer wall of the dual structure of the furnace 302. The furnace is divided into a heat insulating chamber 305 and a molten metal supply chamber 306 by a partition wall 304. A filter 307 is arranged at the central or lower portion of the partition wall 304 so as to cause the two chambers 305 and 306 to communicate with each other. A molten metal 308*a* heated by the heater 303 is stored in the heat insulating chamber 305. In addition, a molten metal 308*b* from which hard spots and oxides are removed by the filter 307 is stored in the molten metal supply chamber 306. The molten metal surface in the chamber 306 is at the same level as that in the chamber 305. The mesh size of the filter 307 is set to decrease the passing speed of the molten metal 308. For example, if injection of 1 kg of a molten metal is performed in a cycle of 20 seconds, a molten metal flow amount is set at 1 kg/20 sec. Reference numeral 309 denotes a molten metal teeming port open to the upper end portion of the furnace 302.

An air cylinder 317 is fixed to the upper surface of the front end portion of the furnace 202. A piston rod 318 of the air cylinder 317 is suspended in the molten metal supply chamber 306. An opening/closing rod 319 made of a ceramic material or the like is concentrically coupled to the operation end of the piston rod 318. A seal ring 320 and a sleeve 321 are fitted in a hole formed in the lower end of the chamber 306. The sleeve 321 includes a valve seat 321*a* which is opened/closed by its distal end valve portion upon forward/backward movement of the opening/closing rod 319. The seal ring 320 includes a valve seat 320*a* which is sealed by its upper end valve portion when the opening/closing rod 319 accidentally breaks. The length of the sleeve 321 is set to allow its distal end to reach a position right above an injection plunger chip. In addition, a heater 327 for heating the sleeve 321 is arranged on a portion A surrounding the sleeve 321.

When the valve seat 321*a* is opened by the opening/closing rod 319, the molten metal 308*b* in the molten metal supply chamber 306 is supplied into the injection sleeve 17. Reference numerals 324*a* and 324*b* denote detection bars, constituted by thermocouples, for detecting the surface of the molten metal 308*b* in the sleeve 321. Molten metal surface detection may be performed by other methods. One thermocouple 324*a* is slightly longer than the other thermocouple 324*b*. In practice, the difference is set to be about 3 mm. With this arrangement, the upper surface position of the molten metal 308*b* in the injection sleeve 17 can be kept within the difference between the lengths of the two thermocouples during a teeming operation, thus minimizing the disturbance of the molten metal. More specifically, control is performed in such a manner that the molten metal 308*b* is always in contact with one thermocouple 324*b* while it is kept away from the other thermocouple 324*a*. For example, when the molten metal 308*b* is brought into contact with the thermocouple 324*b*, the opening/closing rod 319 is actuated to decrease the amount of molten metal to be supplied per unit time to the injection sleeve 17. If the thermocouple 324*a* is separated from the molten metal 308*b*, the amount of molten metal to be supplied is increased. This operation need not necessarily be performed by increasing/decreasing the amount of molten metal to be supplied, but may be performed by increasing/decreasing the descending speeds of the sleeve 17 and the plunger chip 34*a*.

The furnace 302 having the above-described structure is supported by a base 310 and an air cylinder 311 so as to be freely tilted, as indicated by alternate lone and short dashed lines Q in FIG. 8. More specifically, bearings 312 are integrally formed in left and right sides (upper and lower sides in FIG. 8) of the rear end portion of the base 310. A shaft 313 is axially supported to be pivotal in these left and right shafts 312. A pair of left and right supporting arms 314 are fixed to the shaft 313. The left and right ends of the front end portion of the furnace 302 are pivotally supported on the free end portion of the supporting arm 314 by a pin 315. The operation end of a piston rod 316 of the air cylinder 311 pivotally supported on the base 310 side is pivotally supported at a middle position of the lower surface of the furnace 302 in the longitudinal and widthwise directions. With this arrangement, when the piston rod 316 of the air cylinder 316 is moved upward from the position indicated in FIG. 8, the furnace 302 pivots on the pin 315 and is tilled in the direction in which its front end is lowered as indicated by alternate long and short dashed lines P in FIG. 8, with the supporting arm 302 being kept still. If the piston rod 316 of the air cylinder 311 is moved downward from the position indicated in FIG. 8, the furnace 302 pivots on the shaft 313 and is tilted in the direction in which its rear end is lowered as indicated by the alternate long and short dashed lines Q in FIG. 8, while swinging the supporting arm 314. Note that when the furnace 302 is tilted from a position indicated by solid lines to the position indicated by the alternate long and short dashed lines P, the molten metal surface is set at the same level as that of the lower end of the filter 307, as indicated by reference numeral 308L1. If the furnace 307 is tilted from the position indicated by the solid lines to the position indicated by the alternate long and short dashed lines Q, the molten metal surface is set at the same level as that of the lower end of the filter 307, as indicated by reference numeral 308L2. Therefore, no molten metal is left in the molten metal supply chamber 306.

An operation of the automatic molten metal supply apparatus having the above-described arrangement will be described below.

If the molten metal 308*a*, which is supplied from the molten metal teeming port 309 by setting the furnace 302 of the automatic molten metal supply apparatus 301 in the horizontal position indicated by solid lines in FIG. 8, is stored in the heat insulating chamber 305, this molten metal 308*a* passes through the filter 307 and is also stored in the molten metal supply chamber 306 such that its molten metal surface is set at the same level as that of the molten metal stored in the heat insulating chamber 305.

In the vertical die casting machine injection apparatus 3, the sprocket 25 is rotated by the motor 27 through the chain 31 so as to move the plunger chip 34*a* to a desired position, thus ensuring a volume corresponding to a molten metal amount to be filled in a die cavity. Thereafter, a mold release agent is coated on a molten metal contact surface.

In such a state, the injection apparatus 3 is moved to the molten metal teeming position indicated by an alternate long and two short dashed line in FIG. 1 while the balls of the linear guides are caused to roll in the ball grooves, and the distal end portion of the injection sleeve 17 is brought into contact with the molten metal supply port at the lower portion of the molten metal supply chamber 306 of the automatic molten metal supply apparatus 301.

When the air cylinder 317 is actuated to raise the opening/closing rod 319, the molten metal 308*b* is supplied into the injection sleeve 17.

As shown in FIG. 7A to 7C, this molten metal is supplied in the following manner. As shown in FIG. 7A, the supply of the molten metal is started while the plunger chip 34*a* is located at the lowest position. As the supplying operation proceeds, the injection sleeve 17 and the plunger chip 34*a* are simultaneously lowered from the position indicated in FIG. 7A to the position indicated in FIG. 7B. The supplying operation is completed at the lowest position indicated in FIG. 7C.

A method of controlling the amount of molten metal to be supplied will be described below with reference to FIGS. 9 and 10. In this case, the molten metal is supplied from the automatic molten metal supply apparatus 301 into the injection sleeve 17 while the injection sleeve 17 and the plunger chip 34*a* are lowered together at a constant speed of, e.g., 5 to 10 mm/sec. In this case, the simultaneous downward movement of the injection sleeve 17 and the plunger tip 34*a* is started by using a timer (not shown) after the distal end portion of the injection sleeve 17 is brought into contact with the molten metal support port at the lower portion of the molten metal supply chamber 306 of the automatic molten metal supply apparatus 301.

Figure 9:
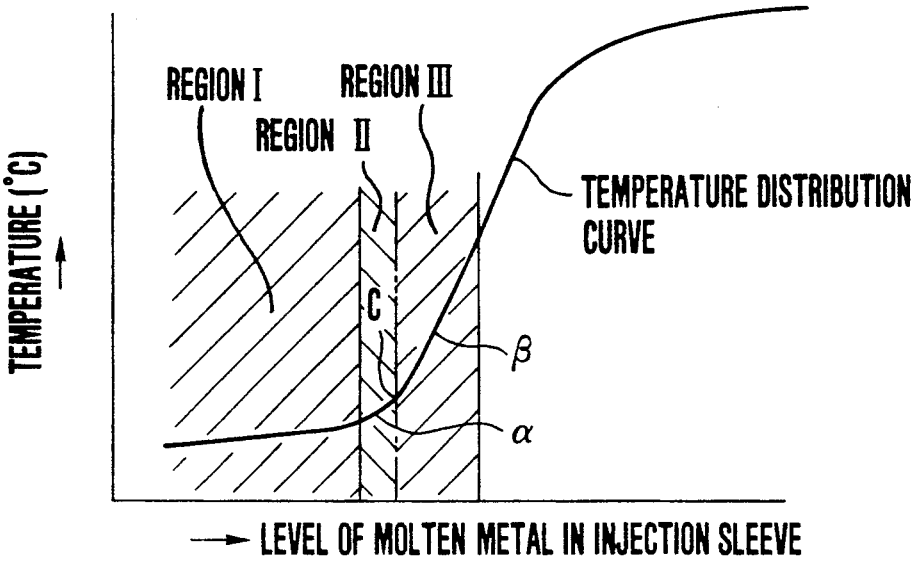
FIG. 9 is a graph showing a detection temperature of a thermocouple as a function of a molten metal level in an injection sleeve.
Figure 10:
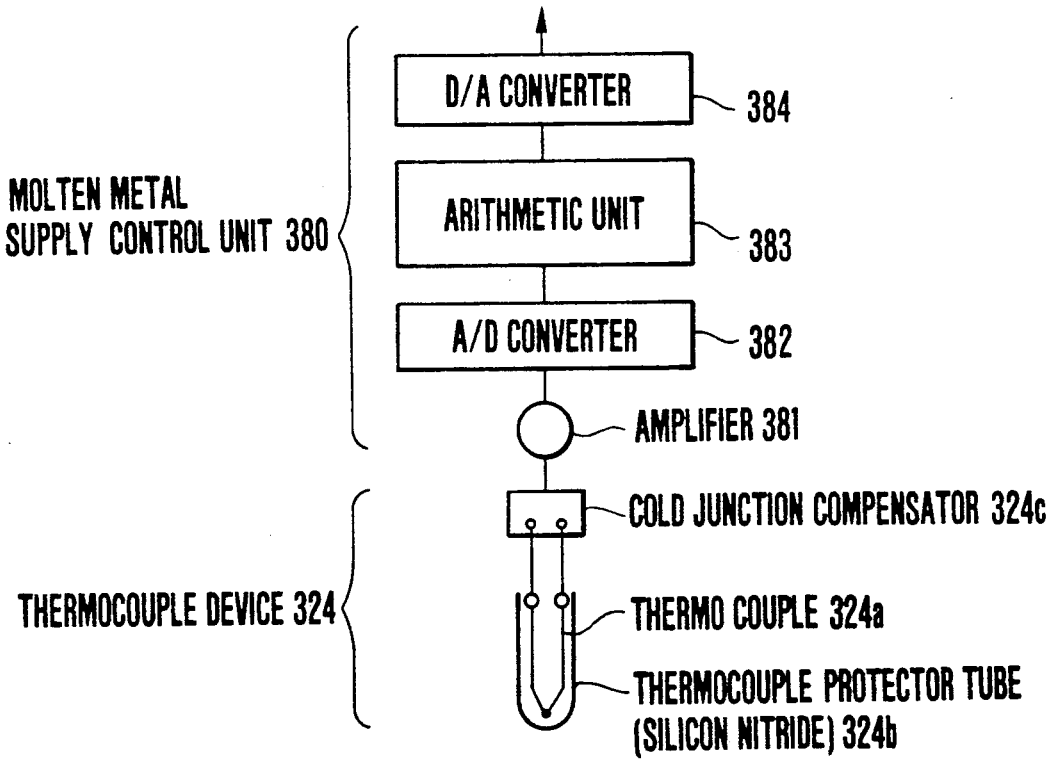
FIG. 10 is a view showing a control system according to the present invention.

Referring to FIG. 9, reference symbol C denotes a position where the molten metal level in the injection sleeve 17 comes into contact with the distal end portion of the thermocouple 324*a*; $\alpha$, a temperature gradient having a value of, e.g., 3° to 8° C./mm in this embodiment, which is obtained when the interface of the molten metal further approaches the distal end portion of the thermocouple 324*a*; and $\beta$, a temperature gradient having a value of, e.g., 20° to 40° C./mm, which is obtained when the interface of the molten metal comes into contact with the distal end portion of the thermocouple 324*a*. The temperature gradients $\alpha$ and $\beta$ are respectively represented by regions I and II.

In the region I, when supply of a molten metal into the injection sleeve 17 is started, the molten metal level is low, and the interface of the molten metal is separated from the distal end portion of the thermocouple 324*a*. In this state, there is no difference between a preset temperature gradient and a measured temperature gradient, and hence no control is performed for the amount of molten metal to be supplied to the injection sleeve 17.

If the supplying operation is continued in this state, the molten metal level is gradually increased, and the molten metal surface gradually approaches the distal end portion of the thermocouple 324*a*. As a result, the temperature curves reaches the region II. In the region II, since the measured temperature gradient is increased, a difference appears between the preset temperature gradient and the measured temperature gradient. As a result, the amount of molten metal to be supplied from the automatic molten metal supply apparatus 301 to the injection sleeve 17 is decreased under the control of a control system shown in FIG. 10.

More specifically, a temperature detected by the thermocouple 324*a* is extracted as a voltage value, and an amplified value proportional to the voltage value, which is obtained by an amplifier 381, is converted by an A/D converter 381 from an analog value into a digital value. The digital value is subjected to arithmetic processing in an arithmetic unit 383. Thereafter, the value is converted into an analog value as an output signal by a D/A converter 84. By controlling the amount of compressed air to be supplied to the air cylinder 317 by using this output signal, the opening/closing rod 319 is lowered via the piston rod 318, and the gap between the valve seat 321*a* and the rod 319 is adjusted to decrease the amount of molten metal flowing from the sleeve 321.

In the region III, the ascending speed of the molten metal level in the injection sleeve 17 is increased relatively to the speed at which the injection sleeve 17 and the plunger chip 34*a* are simultaneously lowered, and the thermocouple 324*a* detects a molten metal temperature at the point C where the interface of the molten metal comes into contact with the distal end portion of the thermocouple 324*a*. At this time, the difference between the preset temperature gradient and the measured temperature gradient is larger than the difference in the region II. Therefore, the amount of compressed air to be supplied to the air cylinder 317 is controlled through the above-described control system. As a result, the opening/closing rod 319 is lowered to eliminate the gap between the valve seat 321*a* and the opening/closing rod 319 so as to stop the supply of the molten metal from the sleeve 321 to the injection sleeve 17.

Although the supply of the molten metal is stopped in this manner, the injection sleeve 17 and the plunger chip 34*a* are continuously and simultaneously lowered at a constant speed. For this reason, the interface of the molten metal is separated from the thermocouple 324*a* by the lowering distance, and the detection temperature of the thermocouple 324*a* exhibits a temperature gradient corresponding to the region II or a right side portion of the region I. As a result, a slightly larger amount of molten metal is supplied to the injection sleeve 17 through the control system. With this operation, the ascending speed of the molten metal exceeds the speed at which the injection sleeve 17 and the plunger chip 349 are simultaneously lowered, and the interface of the molten metal returns to the position where the temperature gradient in the region II is obtained.

Since control is performed to always set a temperature gradient detected by the thermocouple 324*a* in the region II, the descending distance of a molten metal is always kept to be minimum and the molten metal can be supplied very quietly. Therefore, the supplied molten metal is not disturbed.

When a limit switch (not shown) mounted on one end of a piston (not shown) is turned on, the descent of the injection sleeve 17 and the plunger chip 34*a* is stopped at the lowest position. At the same time, the air cylinder 317 is actuated to lower the opening/closing rod 319, and the valve seat 321*a* is closed to stop the supply of the molten metal.

After the supplying operation of the molten metal is performed in this manner, the injection apparatus 3 is horizontally moved from the injection position so as to return to the lower position, as shown in FIG. 1.

When an oil is supplied to the elevating cylinder, the injection sleeve 17 is raised together with the elevating shaft, and is joined to the stationary sleeve of a die. Thereafter, the plunger chip 34*a* is moved upward, and the molten metal in the injection sleeve 17 is injected into the die cavity through the stationary sleeve.

After the injection operation is finished and the injected product is cooled and solidified, the metal molds are opened, and the plunger chip 34*a* is moved backward. In addition, the elevating shaft and the injection sleeve 17 are simultaneously moved backward.

When the injection apparatus 8 is moved to the molten metal teeming position, one cycle is completed.

In this embodiment the air cylinder 317 is actuated to move the opening/closing rod 319 in such a manner that the molten metal 308*c* is always in contact with the distal end portion of one of the two molten metal surface detection bars, i.e., the detection bar 324*a*, thus stably supplying a predetermined amount of molten metal. At the same time, the upper surface position of the molten metal 308*c* in the injection sleeve 17 is kept substantially constant from the start to the end of a supplying operation.

More specifically, assume that the speed at which the injection sleeve 17 and the plunger chip 34*a* are simultaneously lowered is compared with the supply speed of a molten metal from the sleeve 321. For example, when the supply speed of a molten metal from the automatic molten metal supply apparatus 301 is lower than a desired supply speed, the upper surface position of the molten metal is relatively lowered, and the molten metal is separated from the detection bar 324*a*, even if the injection sleeve 17 and the plunger chip 34*a* are lowered at a constant speed. As a result, the air cylinder 17 is actuated to move the opening/closing rod 319 so as to increase the amount of molten metal t be supplied.

In contrast to this, if the supply speed of a molten metal from the automatic molten metal supply apparatus 301 is higher than a desired supply speed, the upper surface position of the molten metal 308*c* is relatively raised, and the molten metal 308*c* is brought into contact with the other detection bar 324*b*, even if the injection sleeve 17 and the plunger chip 34*a* are lowered at a constant speed. As a result, the air cylinder 317 is actuated to move the opening/closing rod 319 so as to decrease the amount of molten metal to be supplied.

A control sequence for always keeping a constant upper surface position of a molten metal in the injection sleeve 17 in this manner is used in the automatic molten metal supply apparatus. This control method is an example. The following methods may be employed: (1)

controlling the speed at which the sleeve is lowered; and (2) controlling the pressure in the molten metal supply chamber or controlling the height of a molten metal surface. When a limit switch (not shown) mounted on one end of the piston 44 is turned on, the descent of the injection sleeve 17 and the plunger chip 34*a* is stopped. At the same time, the air cylinder is actuated to move the opening/closing rod 319 downward. As a result, the valve seat 321*a* is closed to stop the supply of the molten metal. If oxidation must be prevented an inert gas may be filled in the injection sleeve during this period. After the supply of the molten metal is completed in this manner, the injection apparatus 3 is horizontally moved to return to the lower position of the injection position indicated by the solid lines in FIG. 1.

Figure 11:
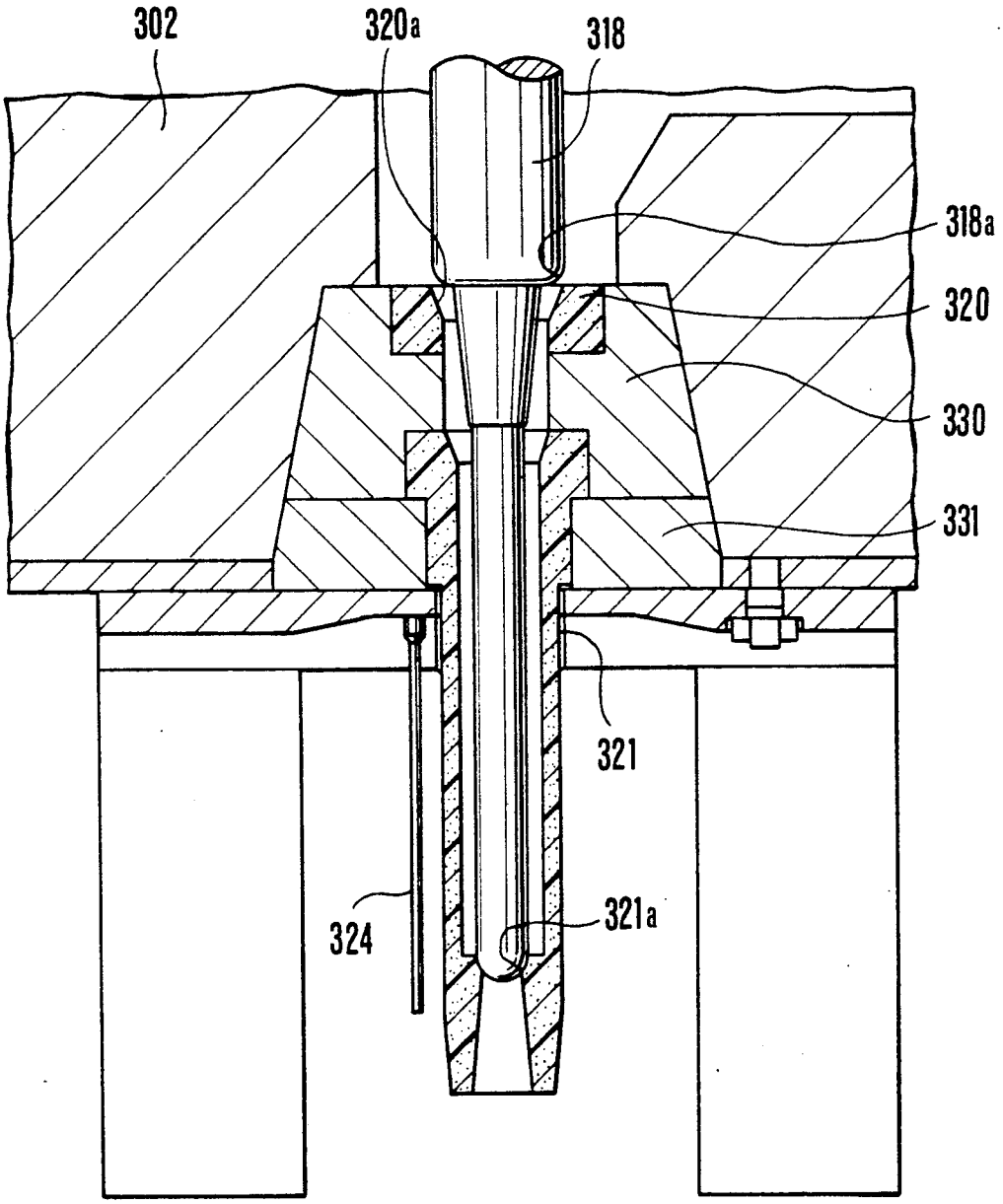
FIG. 11 is a sectional view showing a main part of a modification of a molten metal discharge portion of the automatic molten metal supply apparatus.

FIG. 11 shows a modification of the molten metal discharge portion of the molten metal supply apparatus. This modification is different from the above-described embodiment in that the positional relationship between the valve seat 320 and the sleeve 321 is changed to facilitate mounting of each component. Note that reference numerals 330 and 331 denote members on which the valve seat 320 and the sleeve 321 are mounted.

In the above-described embodiment, the thermocouple is used to detect the level of a molten metal in the injection sleeve. However, a known molten metal surface detection bar may be used to detect the level of a molten metal by detecting whether its distal end comes into contact with the molten metal surface.

Furthermore, in the above embodiment, the two thermocouples are used to adjust the level of a molten metal in the injection sleeve in the following manner. Both the thermocouples are separated from a molten metal for a while after a supplying operation is started. If the lower thermocouple is brought into contact with the molten metal and both the thermocouples are subsequently brought into contact with the molten metal, the opening of the valve is decreased. If both the thermocouples are separated from the molten metal, the opening of the valve is increased. With this control, the surface of the molten metal is kept between the lower ends of the two thermocouples.

Instead of controlling the opening of the valve, the descending speed of the injection sleeve and the plunger chip may be controlled.

The injection apparatus 3 is not limited to the one which is vertically and horizontally moved by the ball screw device as shown in FIGS. 1 to 5. The present invention can be applied to any types of injection apparatuses which are laterally moved to the injection position below the metal molds 102 and 106 and are subsequently moved upward upon reception of a molten metal supplied from the sleeve 321 of the automatic molten metal supply apparats 301 while the injection sleeve 17 and the plunger chip 34*a* are lowered. For examples, the present invention can be applied to an injection apparatus which is vertically or horizontally moved by the action of a cylinder, or apparatuses which are laterally moved by tilting, as disclosed in, e.g., U.S. Pat. Nos. 4,088,178, 4,287,935, 4,655,274, 4,690,197, and 4,741,379, or apparatuses which are horizontally moved by rotation, as disclosed in, e.g., U.S. Pat. No. 4,842,038. In addition, a mold clamping apparatus is not limited to a horizontal mold clamping apparatus as shown in FIG. 1. The present invention can be brought to vertical mold clamping apparatuses, as disclosed in e.g., U.S. Pat. Nos. 4,088,178, 4,287,935, and 4,842,038.

Note that if the injection apparatus 3 is to be moved by tilting, the molten metal supply apparats is also tilted in accordance with the tilt angle of the apparatus 3, thus coaxially setting the injection sleeve 17 and the sleeve 321.

In the above embodiment, the ball screw device is exemplified as a rotational-linear motion transmission mechanism for transmitting the motion of the motor to the supporting frame. The ball screw device, however, may be a normal screw device constituted by a screw shaft and a nut to be threadably engaged with the screw shaft or a transmission mechanism constituted by a rack and a pinion. If the above ball screw device or a normal screw device is to be used, either a screw shaft side or a ball holder or nut side may be rotationally driven.

In addition, according to the above embodiment, the present invention is applied to the vertical die casting machine. The present invention, however can be applied to a horizontal die casting machine and can be similarly applied to a plastic injection molding machine to obtain the same effects.

As is apparent from the above description, according to the present invention, when a molten metal is to be injected into the injection sleeve of a vertical die casting machine, supply of a molten metal is started from the automatic molten metal supply apparatus while the plunger chip is set at a lower position. As the supply of the molten metal proceeds, the injection sleeve and the plunger chip are simultaneously moved downward. With this operation, since a mold release agent coated on the molten metal contact surface is kept applied, seizing can be prevented.

In addition, since the descending distance of a molten metal is always kept to be minimum, the molten metal can be supplied very quietly. Therefore, inclusion of a gas and oxides can be suppressed as compared with the conventional apparatus, and slag can be minimized. This greatly improve the quality of a product.

What is claimed is:

1. A method of supplying a molten metal, comprising the steps of starting a supplying operation of the molten metal after a molten metal discharge port formed in a lower end portion of a molten metal supply sleeve facing down on a bottom portion of a molten metal supply vessel is positioned right above a plunger tip located at a lower position within an injection sleeve of an injection apparatus, and simultaneously lowering said injection sleeve and said plunger tip in accordance with the supplying operation of the molten metal.

2. A method according to claim 1, wherein the supplying operation of the molten metal is related to an amount of molten metal to be supplied per unit time, and the amount of molten metal to be supplied is determined in relation to a change in surface level of the molten metal supplied into said injection sleeve.

3. A method according to claim 2, wherein the change in surface level of the molten metal is detected by a molten metal surface detection bar, and said injection sleeve and said plunger tip are simultaneously lowered in accordance with molten metal surface detection of said molten metal surface detection bar.

4. A method according to claim 3, wherein the change in surface level of the molten metal is detected on the basis of a temperature change detected by a temperature sensor arranged near the molten metal discharge port, and said injection sleeve and said plunger tip are simultaneously lowered in accordance with molten surface detection of said temperature sensor.

5. A method according to claim 4, wherein said temperature sensor is constituted by two thermocouples having different lengths, said two thermocouples being separated from a molten metal at the start of a molten metal supplying operation, an amount of molten metal to be supplied from said molten metal supply sleeve is decreased when said two thermocouples are submerged in the molten metal after the molten metal supplying operation proceeds and said longer thermocouple is submerged in the molten metal, and the amount of molten metal to be supplied is increased when said two thermocouple are separated from the molten metal, thereby setting the surface of the molten metal between distal ends of said two thermocouples.

6. A method according to claim 2, wherein the amount of molten metal to be supplied is adjusted by adjusting the molten metal discharged from said molten metal supply sleeve of said molten metal supply vessel by changing an opening of a valve or a speed at which said injection sleeve and said plunger tip are lowered.

7. A method according to claim 1, wherein said molten metal supply vessel comprises a front molten metal supply chamber communicating with said molten metal supply sleeve, and a rear heat insulating chamber communicating with said front molten metal supply chamber via a passage having a filter, and an amount of molten metal in said front molten metal supply chamber is adjusted by tilting said molten metal supply vessel.

8. A molten metal supply structure comprising a molten metal supply vessel having a molten metal supply sleeve arranged downward on a bottom portion thereof, and a mechanism for positioning a molten metal discharge port in a lower end portion of said molten metal supply sleeve right above a plunger tip located at a lower position within an injection sleeve of an injection apparatus, in which said plunger tip is housed to be axially movable, and for simultaneously lowering said injection sleeve and said plunger tip in relation to a molten metal supplying operation.

9. A structure according to claim 8, wherein the supplying operation of the molten metal is related to an amount of molten metal to be supplied per unit time, and the amount of molten metal to be supplied is determined in relation to a change in surface level of the molten metal supplied into said injection sleeve.

10. A structure according to claim 9, wherein the change in surface level of the molten metal is detected by a molten metal surface detection bar, and said injection sleeve and said plunger tip are simultaneously lowered in accordance with molten metal surface detection of said molten metal surface detection bar.

11. A structure according to claim 9, wherein the change in surface level of the molten metal is detected on the basis of a temperature change detected by a temperature sensor arranged near the molten metal discharge port, and said injection sleeve and said plunger tip are simultaneously lowered in accordance with molten surface detection of said temperature sensor.

12. A structure according to claim 11, wherein said temperature sensor is constituted by two thermocouples having different lengths, said two thermocouples being separated from a molten metal at the start of a molten metal supplying operation, an amount of molten metal to be supplied from said molten metal supply sleeve is decreased when said two thermocouples are submerged in the molten metal after the molten metal supplying operation proceeds and said longer thermocouple is submerged in the molten metal, and the amount of molten metal to be supplied is increased when said two thermocouple are separated from the molten metal, thereby setting the surface of the molten metal between distal ends of said two thermocouples.

13. A structure according to claim 8, wherein the amount of molten metal to be supplied is adjusted by adjusting the molten metal discharged from said molten metal supply sleeve of said molten metal supply vessel by changing an opening of a valve or a speed at which said injection sleeve and said plunger tip are lowered.

14. A structure according to claim 8, wherein said molten metal supply vessel comprises a front molten metal supply chamber and a rear heat insulating chamber, said front molten metal supply chamber including a valve for controlling an amount of molten metal to be supplied to said molten metal supply sleeve, and a passage having a filter is formed between said front molten metal supply chamber and said rear heat insulating chamber.

15. A structure according to claim 8, wherein said molten metal supply vessel comprises a front molten metal supply chamber and a rear heat insulating chamber, said front molten metal supply chamber including a valve for controlling an amount of molten metal to be supplied to said molten metal supply sleeve, a passage having a filter is formed between said front molten metal supply chamber and said rear heat insulating chamber, said molten metal supply apparatus is mounted on a base so as to be pivoted forward on a lower portion of one end side thereof, and said molten metal supply apparatus is mounted on said base so as to be pivoted backward on a lower portion near a central portion thereof by moving the other end side thereof downward.

16. A structure according to claim 14, wherein said valve comprises first and second valves which are interlocked with each other, said first valve including a small-diameter valve portion formed on said molten metal supply sleeve, and said second valve including a large-diameter valve portion which is always open.

17. A method of supplying a molten metal for a die casting vertical injection apparatus, comprising the steps of:

arranging a plunger tip to be vertically movable in an injection sleeve;

setting said injection sleeve to be movable between an injection position and a molten metal supply position, said plunger tip being able to be moved vertically together with said injection sleeve or independently thereof;

positioning a molten metal discharge port formed in a lower and portion of a molten metal supply sleeve to face down on a bottom portion of a molten metal supply vessel right above said plunger tip located at a lower position within said injection sleeve of said injection apparatus;

supplying a molten metal by opening a valve mounted on the molten metal discharge port; and lowering said injection sleeve and said plunger simultaneously in accordance with a molten metal supply operation.

* * * * *